US009666106B2

(12) United States Patent
Walker

(10) Patent No.: US 9,666,106 B2
(45) Date of Patent: May 30, 2017

(54) SYSTEM OF PERIPHERAL ADVERTISEMENTS ABOUT A DISPLAY

(71) Applicant: John Lowell Walker, Seffner, FL (US)

(72) Inventor: John Lowell Walker, Seffner, FL (US)

( * ) Notice: Subject to any disclaimer, the term of this patent is extended or adjusted under 35 U.S.C. 154(b) by 0 days.

(21) Appl. No.: 15/009,301

(22) Filed: Jan. 28, 2016

(65) Prior Publication Data

US 2016/0225297 A1 Aug. 4, 2016

Related U.S. Application Data

(60) Provisional application No. 62/109,329, filed on Jan. 29, 2015.

(51) Int. Cl.

| | |
|---|---|
| ***G09F 15/00*** | (2006.01) |
| ***G09F 7/18*** | (2006.01) |
| ***G09F 13/18*** | (2006.01) |

(52) U.S. Cl.

CPC ..... *G09F 15/0012* (2013.01); *G09F 7/18* (2013.01); *G09F 13/18* (2013.01); *G09F 2007/1843* (2013.01); *G09F 2013/1881* (2013.01)

(58) Field of Classification Search

CPC ..... G09F 15/0012; G09F 7/18; G09F 13/18; G09F 2007/1843; G09F 2013/1881

See application file for complete search history.

(56) References Cited

U.S. PATENT DOCUMENTS

| | | | | |
|---|---|---|---|---|
| 5,233,773 | A * | 8/1993 | Reynolds | G09F 7/22 248/289.31 |
| 5,890,309 | A * | 4/1999 | Markarian | G09F 7/22 40/605 |
| 6,510,631 | B1 * | 1/2003 | Baggarly | A47G 1/12 206/0.84 |
| 6,543,168 | B1 * | 4/2003 | Moore | G06F 1/1607 40/725 |
| 6,688,029 | B1 * | 2/2004 | Dunn | A47G 1/06 40/711 |
| 2005/0252059 | A1 * | 11/2005 | Marks | A47G 1/0627 40/799 |
| 2008/0129646 | A1 * | 6/2008 | Bhavnani | A47G 1/14 345/1.1 |
| 2011/0239511 | A1 * | 10/2011 | Wisniewski | A47G 1/0616 40/711 |
| 2015/0027016 | A1 * | 1/2015 | Best | G09F 9/30 40/711 |

* cited by examiner

*Primary Examiner* — Gary Hoge

(57) ABSTRACT

One or more frame bodies are provide for attachment to a display device. The one or more frame bodies are formed by a backing and edging frame, with a display region being created between the backing and the edging frame. The display region is accessible through an item-receiving slot, the item receiving slot cutting through the edging frame. More specifically, the display region is bounded by the backing and an interior surface of the edging frame, while the item-receiving slot cuts through an exterior surface of the edging frame. Advertisements are created by means of a printed graphic, which can be positioned on the removable insert as well as the edging frame. The removable insert is placed in the display region, and can be protected by a transparent cover. Advertisements can be enhanced by illumination sources and ocular-stimulating accessories.

10 Claims, 10 Drawing Sheets

SYSTEM OF PERIPHERAL ADVERTISEMENTS ABOUT A DISPLAY

The current application claims a priority to the U.S. Provisional Patent application Ser. No. 62/109,329 filed on Jan. 29, 2015.

FIELD OF THE INVENTION

The present invention relates generally to a system that provides individual advertising units that can be attached to an existing display such as a television.

BACKGROUND OF THE INVENTION

The cost of advertisement today is substantially high, requiring advertisers to pay large sums of money to gain some exposure for their business. Advertisements typically come in the form of television commercials, billboards, newspaper ads, or magazine ads. These traditional forms of advertisements can cost thousands of dollars for limited amounts of exposure. There exists a need for an adaptable and economical method of advertising.

The present invention overcomes the traditional advertisement methods by introducing a new advertising platform. Many sports bars and restaurants display a plurality of televisions for patrons to view. A large number of service and retail businesses additionally have one or more televisions on their premises. The present invention seeks to convert these televisions and similar display devices into advertising opportunities by providing creating a system that allows for one or more advertising units to be attached to a television. The present invention has removable inserts, allowing for easy changing of advertisements. The addition of an advertising platform to a television compels patrons viewing the television not only to see the television but also see the advertisements positioned around the bezel or frame of the television.

It is therefore an object of the present invention to provide an economical and adaptable means of providing periphery advertising for flat panel displays.

DETAIL DESCRIPTIONS OF THE INVENTION

All illustrations of the drawings are for the purpose of describing selected versions of the present invention and are not intended to limit the scope of the present invention.

The present invention is a system that allows for advertisements to easily be retrofitted to display panels. While the description of the present invention focuses on adding advertising capability to digital displays (i.e. televisions), the present invention is applicable to all display panels, digital and otherwise. The present invention is illustrated in FIG. 1-FIG. 10.

Figure 1:
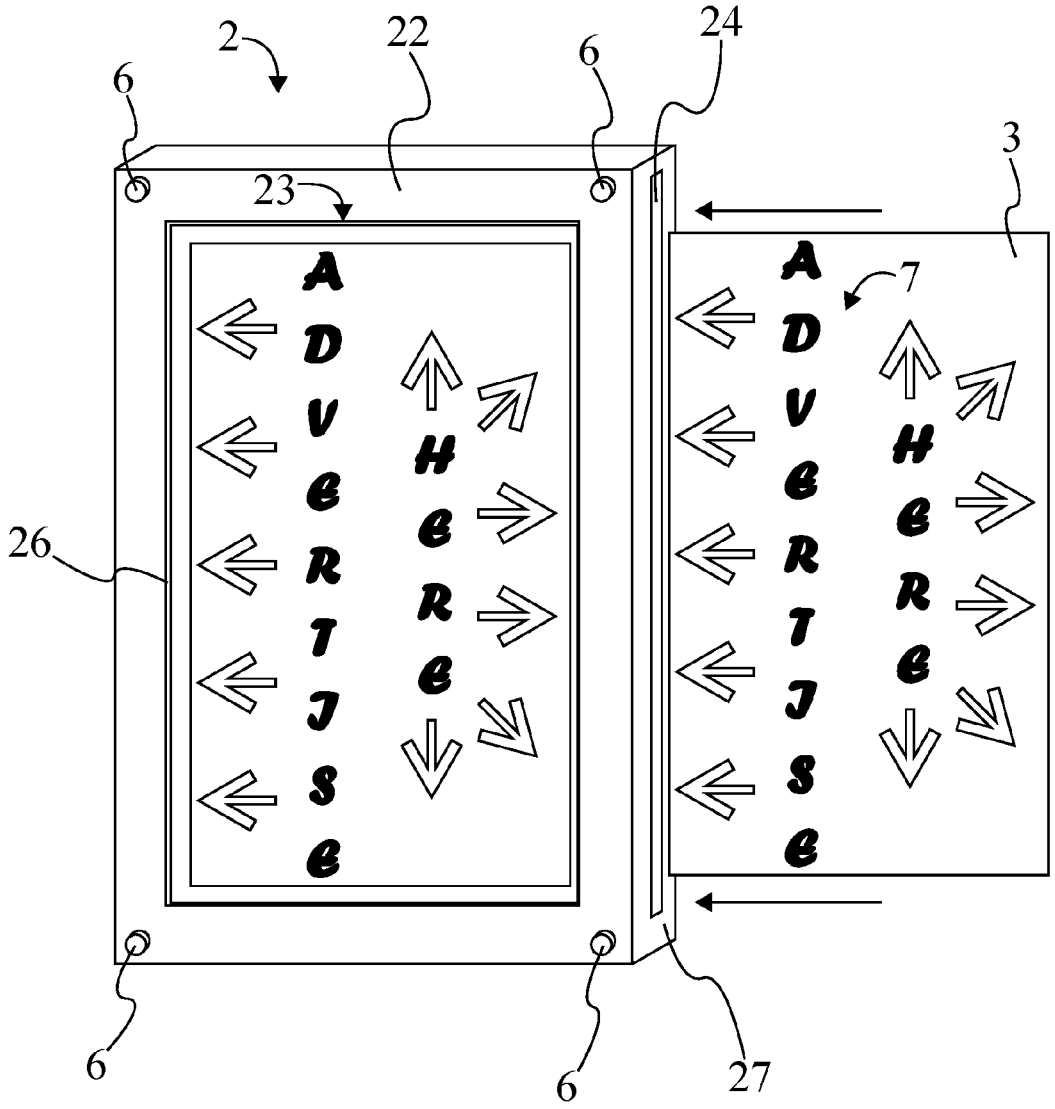
FIG. 1 is an illustration showing a removable insert placed in a display region of a frame body.
Figure 2:
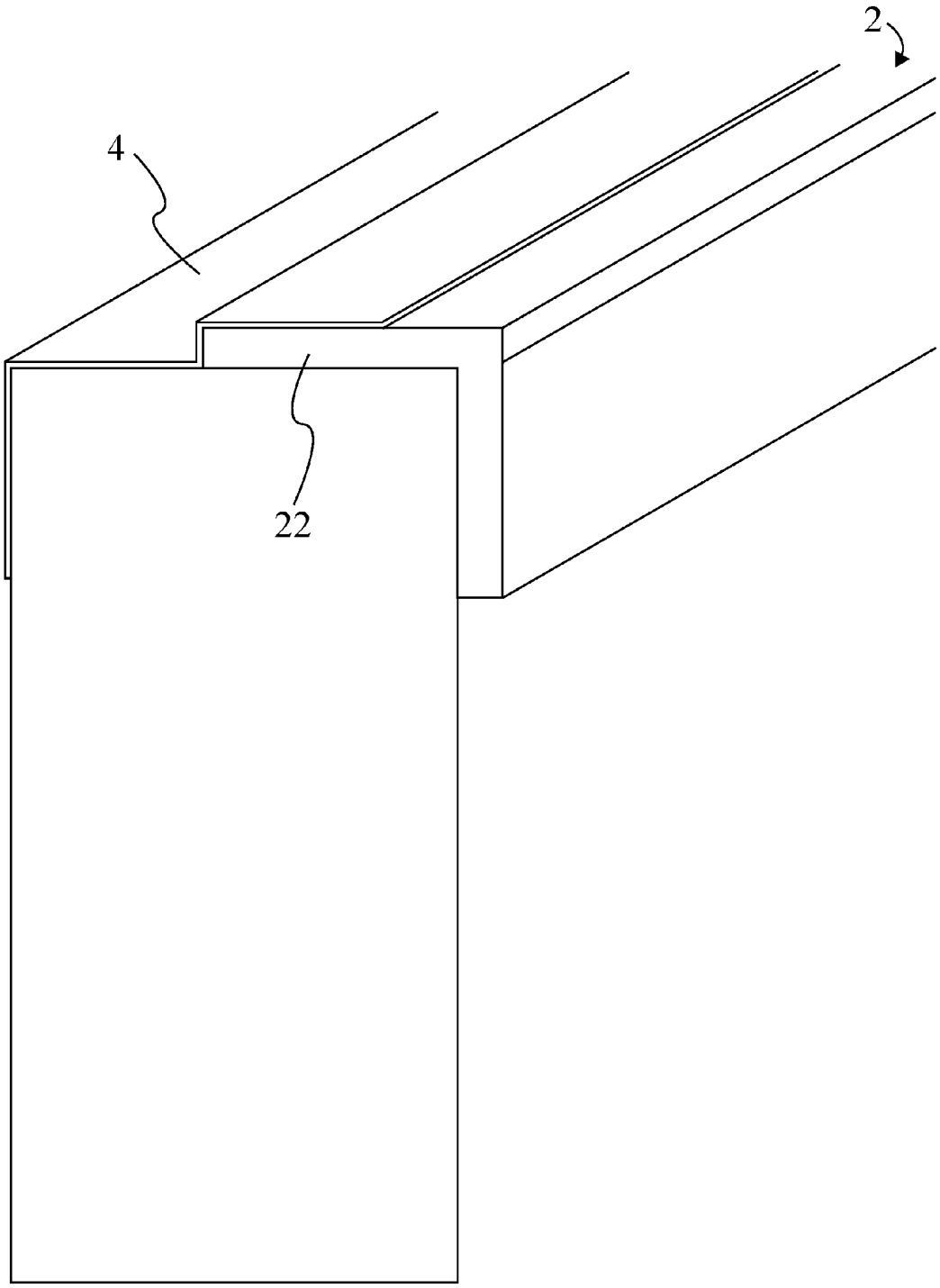
FIG. 2 is a view showing an adhesive strip which joins the frame body to a display.
Figure 3:
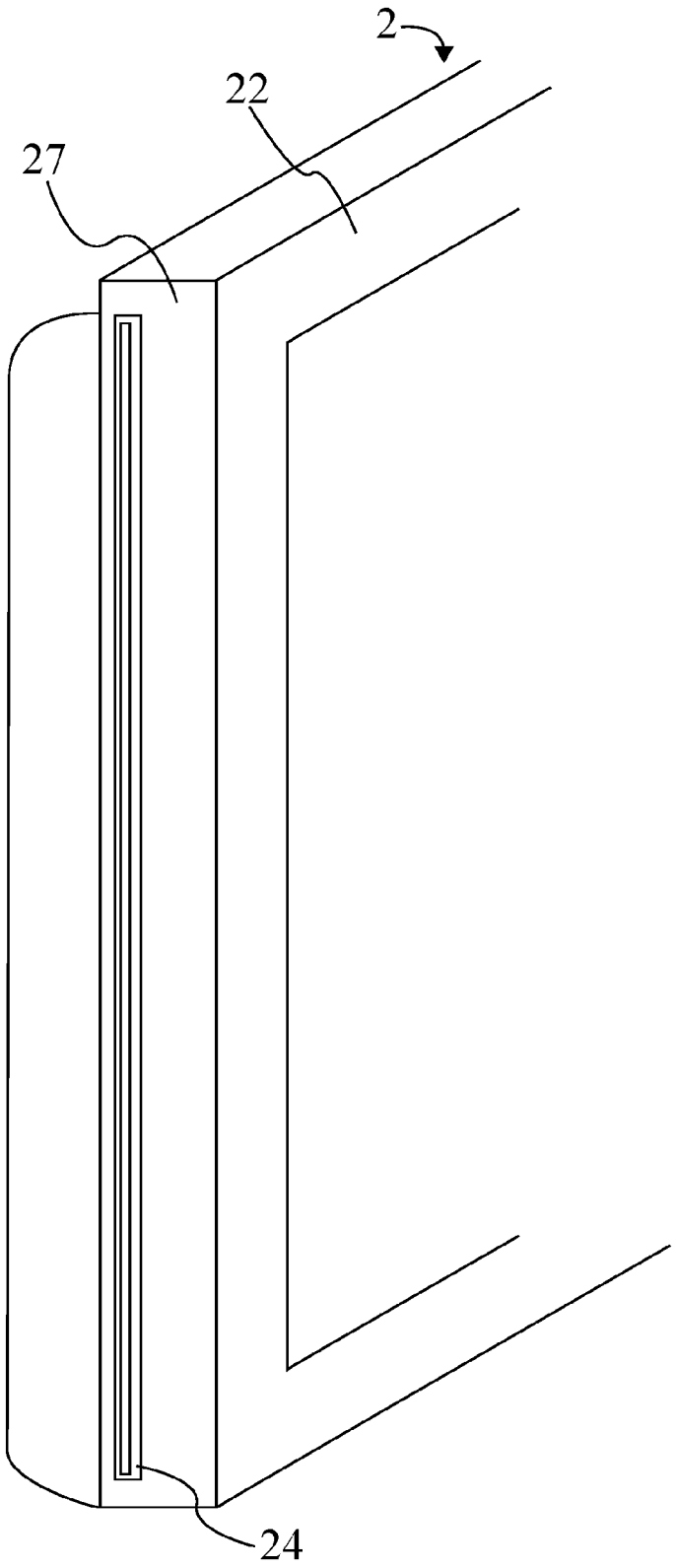
FIG. 3 is a perspective view showing an item-receiving slot of the frame body.
Figure 4:
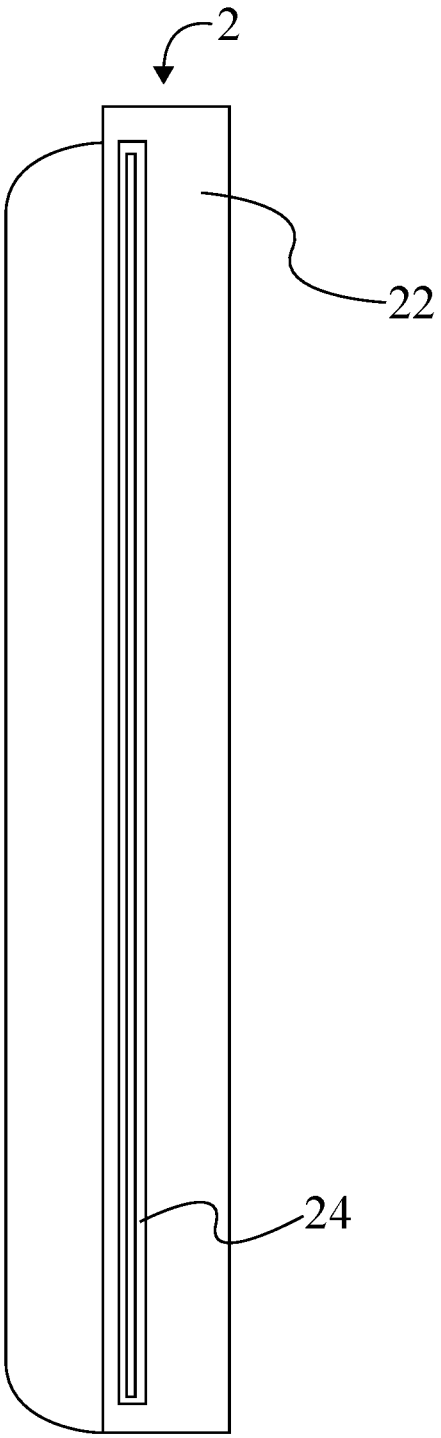
FIG. 4 is a side view thereof.

To this end, the present invention comprises an at least one advertising unit 1, the advertising unit 1 itself comprising a frame body 2 and a removable insert 3. The present invention allows for more than one advertising unit 1, if desired, to be attached to the same display panel. The frame body 2 of the advertising unit 1 comprises a backing 21, an edging frame 22, a display region 23, an item-receiving slot 24, and an edging frame 22. The edging frame 22 comprises an interior surface 26 and an exterior surface 27. The backing 21 serves as a rear of the frame body 2; the edging frame 22 serves as a border, being adjacently connected along the perimeter of the backing 21. The display region 23 is defined as the area formed between the backing 21 and the edging frame 22. In order to allow a removable insert 3 (such as an advertisement) to be placed within the display region 23, the item-receiving slot 24 traverses into the display region 23 through the edging frame 22. Resultantly, the removable insert 3 is positioned within the display region 23. A lone frame body 2 is shown in FIG. 1-FIG. 5, while multiple frame bodies 2 joined to a display are shown in FIG. 6-FIG. 10. The basic configuration described above provides an independent advertising unit 1 which can be attached to a television in a number of manners. For example, in a simple embodiment an adhesive strip 4 (an example of which is tape) is connected along the edging frame 22. The adhesive strip 4 is also connected along the bezel of a display, serving to secure the frame body 2 to said display. In short, the adhesive strip 4 is connected along both the frame body 2 and a display in order to attach the frame body 2 to a display. Resultantly, an advertisement (i.e. the removable insert 3) can be provided alongside the display. An example of an adhesive strip 4 is shown in FIG. 2.

The present invention is not limited to using adhesive strips 4 for securing the frame body 2 to a display. For example, other embodiments could utilize double-sided adhesives, fasteners (e.g. screws), hook-and-loop fasteners, straps, clamps, and even magnets in order to secure the frame body 2 to the display. It is noted that such alternatives often have drawbacks in that they require more expensive materials and require permanent alterations to be made to the display. The adhesive strip 4, in comparison, can be removed without causing damage to the display. Ultimately, however, the present invention is compatible with these and further variations for the means of attaching the frame body 2 to the display.

To provide additional support, in one embodiment the frame body 2 further comprises a bracing member 25. Helpful for when placing the frame body 2 to the side of a display, the bracing member 25 is adjacently and perpendicularly connected to the exterior surface 27 of the edging frame 22. The bracing member 25 is further defined as being positioned opposite the item-receiving slot 24 along the edging frame 22; this ensures that the item-receiving slot 24 remains accessible even when the bracing member 25 is joined to a display. For example, if the frame body 2 is placed on the left side of the display, the bracing member 25 is positioned on the right side of the frame body 2 (i.e. next to the display) while the item-receiving slot 24 is positioned on the left side of the frame body 2 (i.e. away from the television). A user thus has ample space to access removable inserts 3 placed within the display region 23. A bracing member 25 is visible in FIG. 6-FIG. 10. Potentially, the item-receiving slot 24 can traverse into any side of the edging frame 22, allowing removable inserts to be loaded into the display region 23 through the top, left, right, or even bottom of the frame body 2.

The bracing member 25 itself essentially acts as an arm for the frame body 2, the bracing member 25 being placed over the top of a display. Such positioning of the bracing member 25, in combination with the adhesive strip 4 or similar coupling means, helps better distribute the weight of the frame body 2 across the display. This culminates in a more secure attachment between the frame body 2 and the display. Bracing members 25 are advantageous for frame bodies 2 which are positioned to either side of a display. One (or two) bracing members 25 can also be provided for frame bodies which are positioned below a display, though such a bracing member 25 may also necessitate a lip at the free end of the bracing member 25, with the lip resting atop the display. Some care must be taken with sizing of bracing members 25 when multiple frame bodies are used. For example, if placing a frame body 2 on each side of a display, ideally the bracing member 25 of each frame body 2 will be only one half the width of the display. If the bracing members 25 were any larger they would interfere with each other and prevent a compact fit between the frame bodies 2 and the display.

Figure 6:
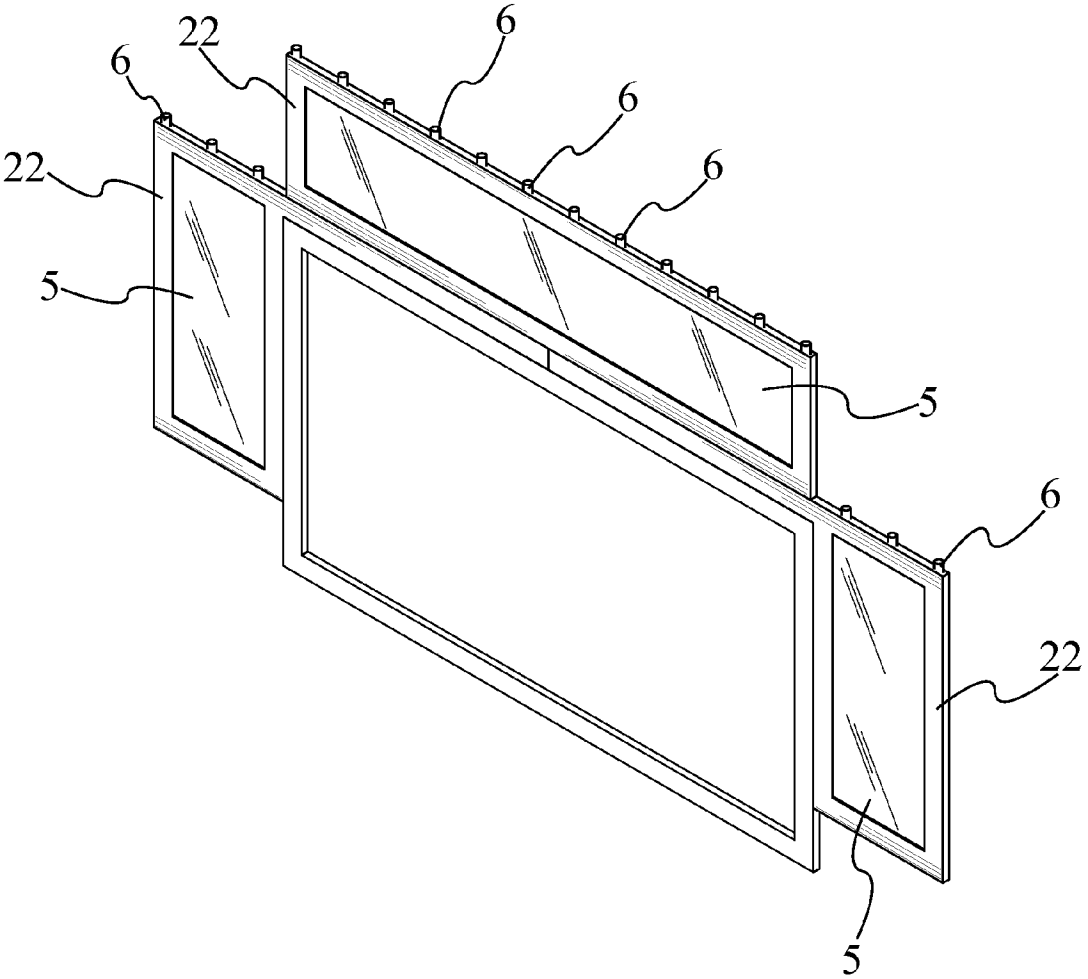
FIG. 6 is a perspective view showing multiple frame bodies with glass covers and illumination sources, joined to a display.
Figure 7:
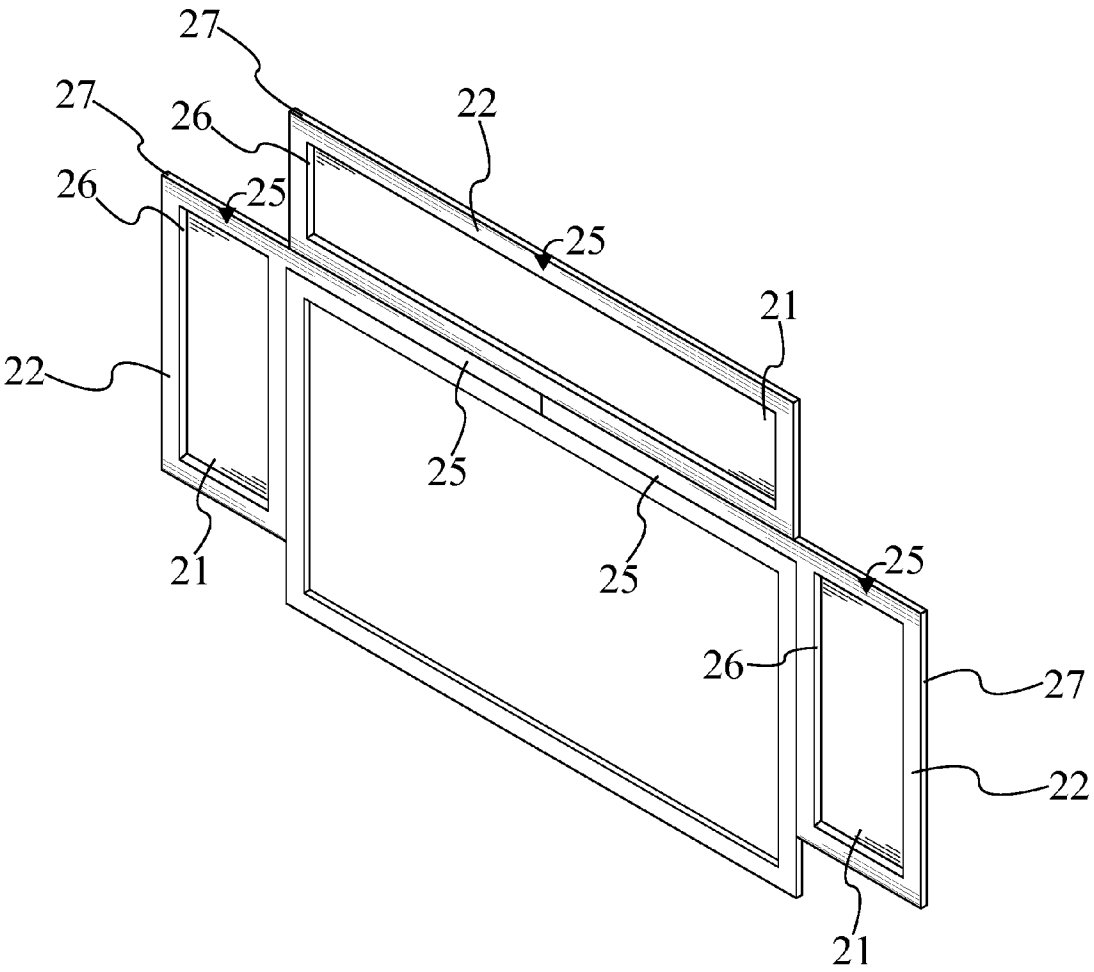
FIG. 7 is a perspective view of multiple empty frame bodies joined to a display.
Figure 8:
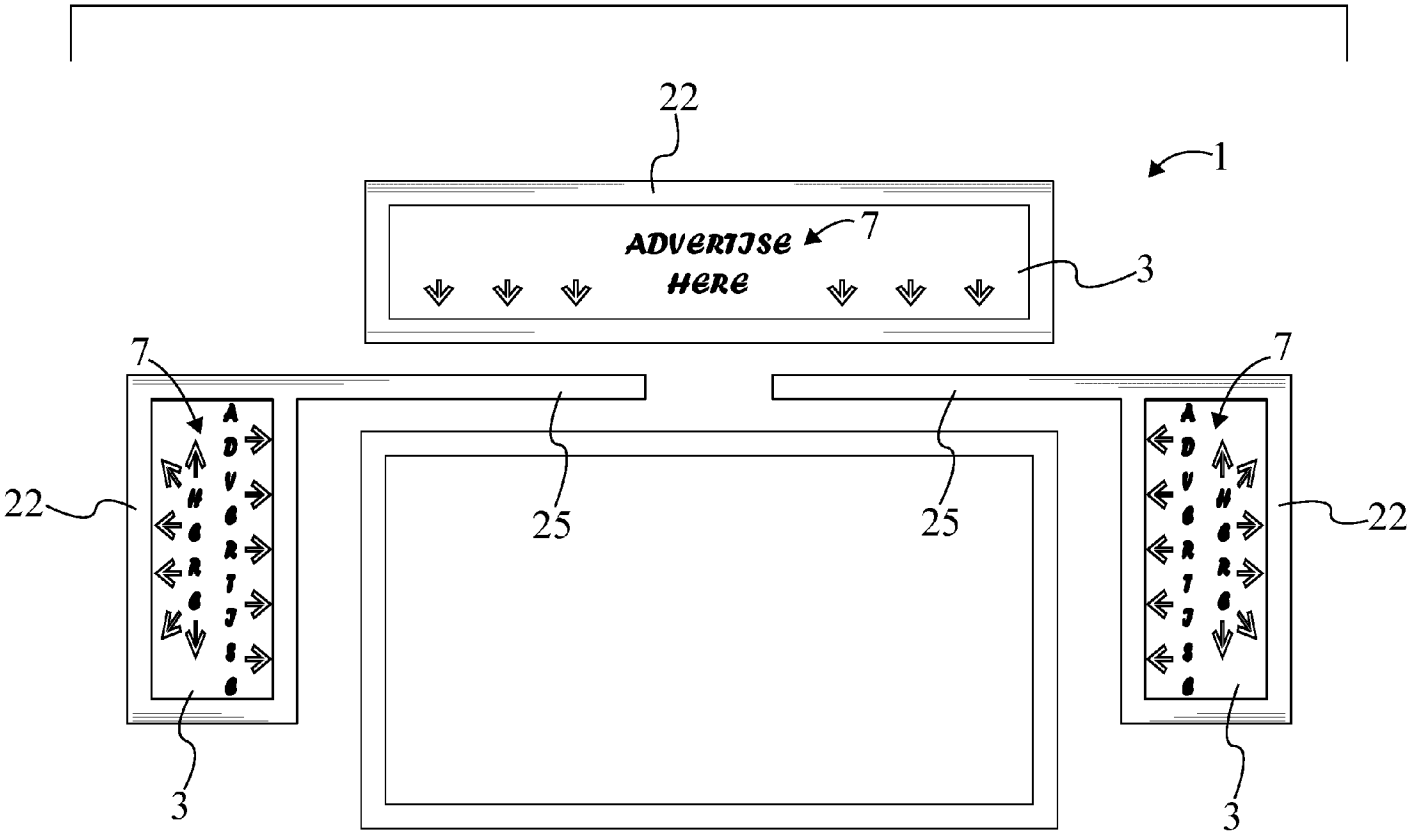
FIG. 8 is an exploded view showing multiple detached frame bodies with removable inserts and a display.
Figure 9:
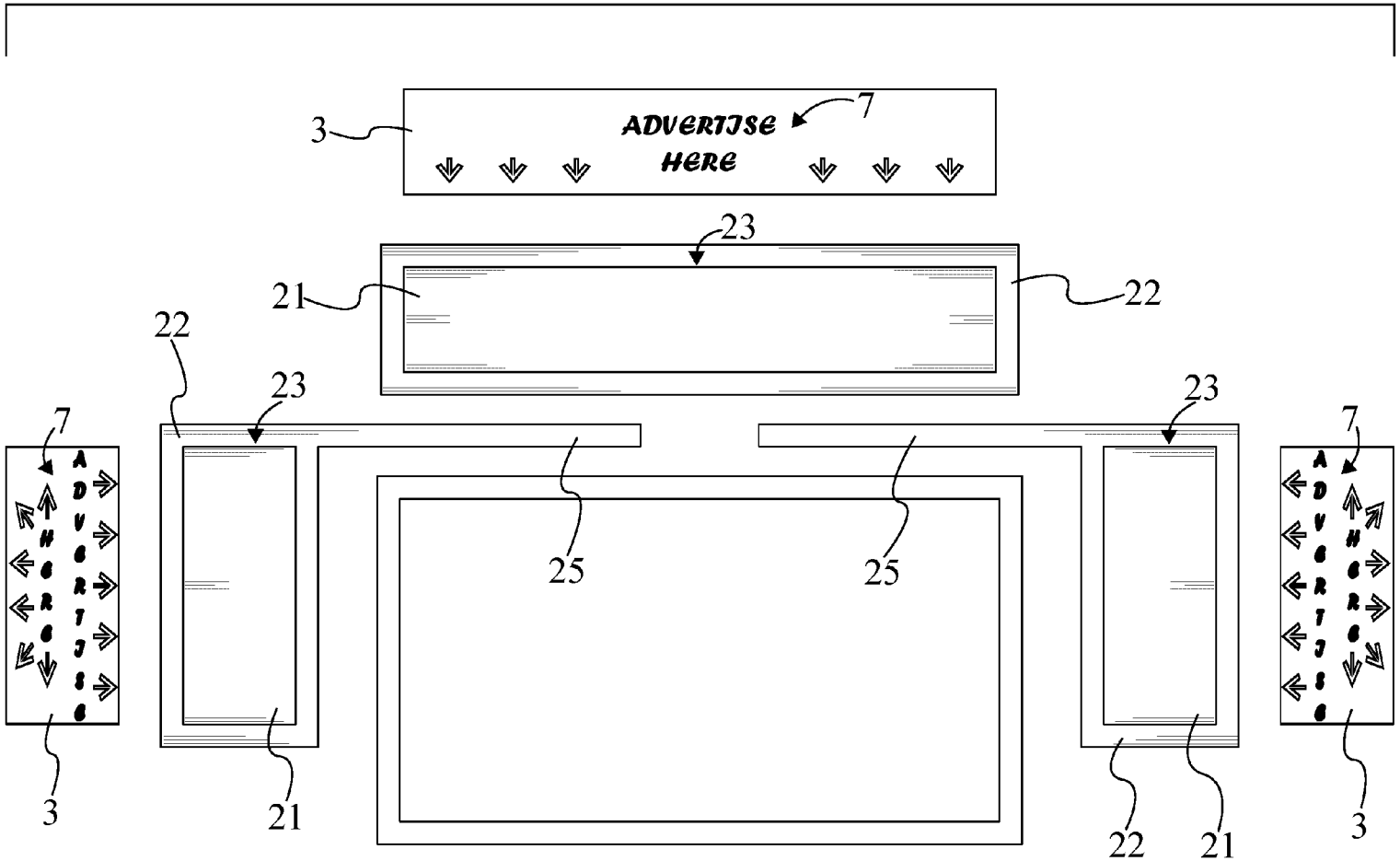
FIG. 9 is an exploded view showing removable inserts, corresponding frame bodies, and a display.
Figure 10:
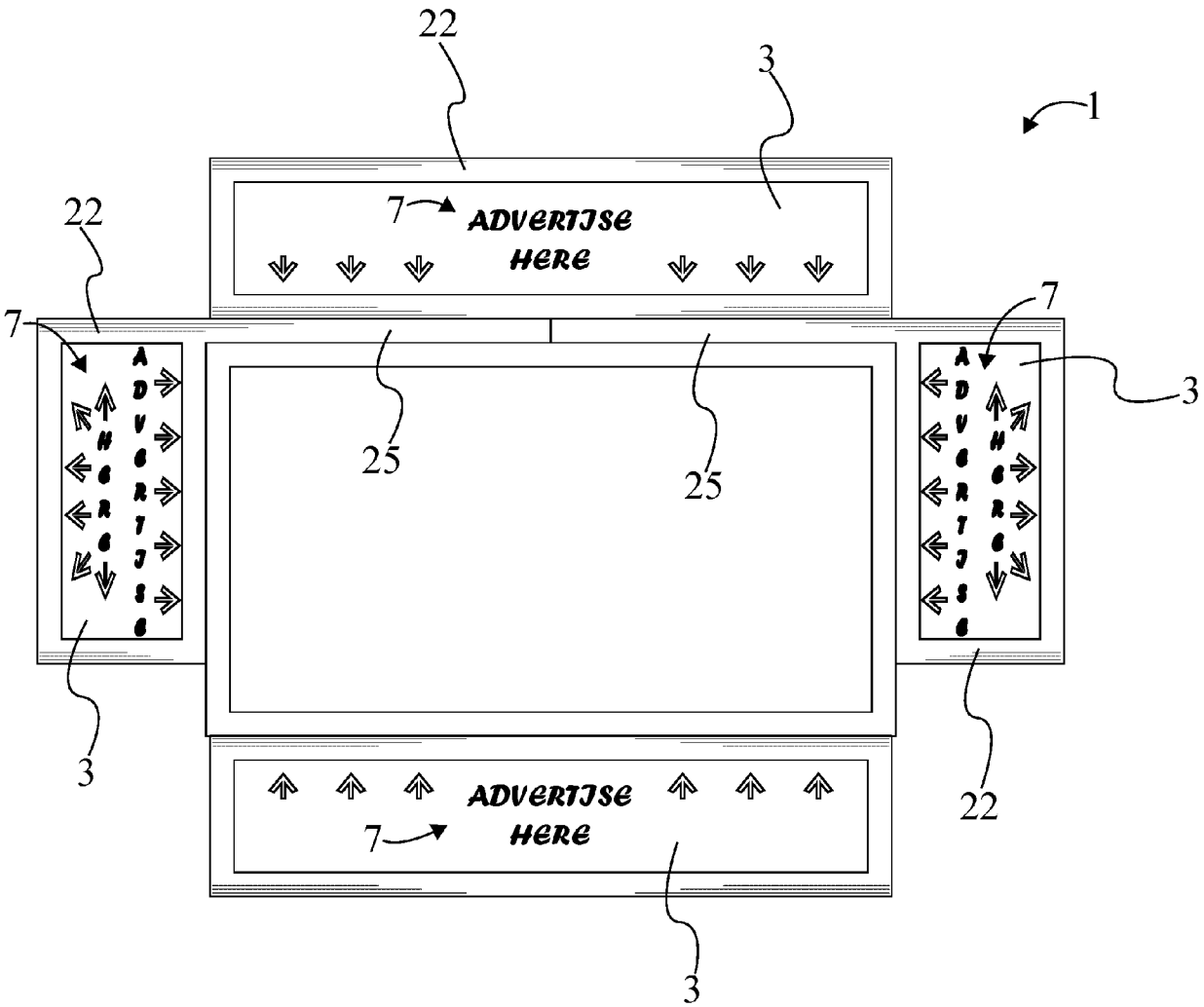
FIG. 10 is a front elevational view showing another possible configuration of frame bodies with a display.

A further possibility for the present invention is the addition of a screen for the frame body 2. The screen covers the removable insert 3, protecting it from environmental damage or debris, for example water. In such an embodiment the present invention comprises a transparent cover 5, with the transparent cover 5 being adjacently connected to the edging frame 22 opposite the backing 21. While the specific material used for the cover is not limited by the present invention, the chosen material should not obstruct sight of the removable insert 3; in other words the material must be transparent. This allows any advertisements placed in the display region 23 to be seen normally. An example of a transparent cover 5 is shown in FIG. 6.

To better illuminate the display region 23 and removable insert 3, a plurality of illumination sources 6 can be adjacently connected to the edging frame 22 around the display region 23. The illumination sources 6 help to enhance the visual effect of the removable insert 3, drawing attention to and better displaying the removable insert 3. The illumination sources 6 can be light-emitting diodes, florescent lights, halogen bulbs, or any of a variety of types of lighting devices. Potential arrangements of illumination sources 6 are shown in FIG. 1 and FIG. 6. The illumination sources 6 themselves can be selected from various colors and combinations thereof, and set to stay on or fluctuate between on and off states.

An advertisement or decoration can be added to the removable insert 3, the edging frame 22, or even both. As an example of the former, a printed graphic 7 (for example words or images advertising a product or service) can be positioned onto the removable insert 3, opposite the backing 21. As an example of the latter, a printed graphic 7 is positioned onto the edging frame 22 itself, opposite the backing 21. This allows for rotating advertisements (of the removable insert 3) to be positioned alongside the display. A more permanent, relevant graphic 7 (e.g. a name and logo of the establishment where the display is located) can be shown on the edging frame 22. Continuing with this example, a bar's name and logo can be shown on the framing edge while advertisements for new brews, promotions, and local sports teams can be shown on the removable insert 3. The printed graphic 7 can be directly marked onto removable insert 3, for example, or could alternatively be printed onto a film of mil plastic which is wrapped around the removable insert 3. Other means of joining the printed graphic 7 to the removable insert 3 or edging frame 22 can be utilized.

Figure 5:
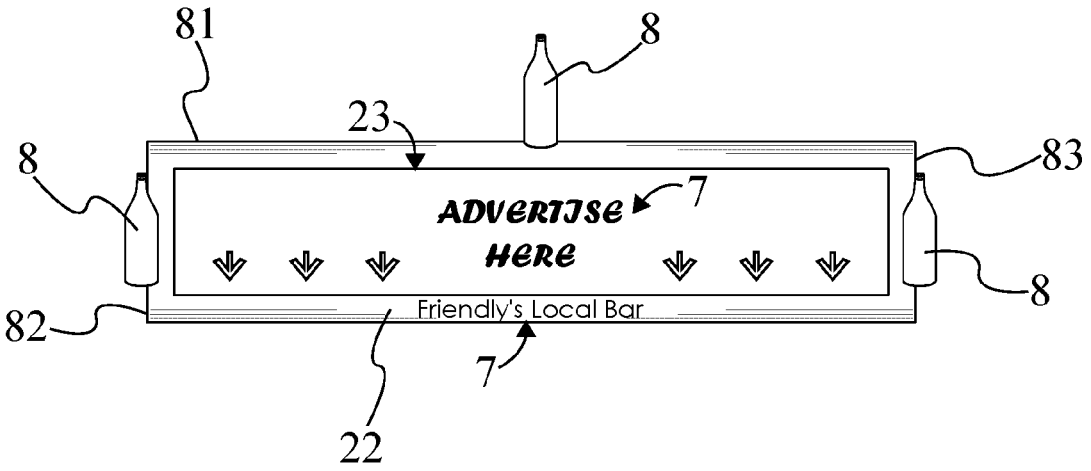
FIG. 5 is a front elevational view showing a frame body with multiple printed graphics and ocular-stimulating accessories.

In place of or in addition to the printed graphic 7, an ocular-stimulating accessory 8 can be included. The ocular-stimulating accessory 8 can be, for example, a beer bottle, sports team mascot, or similar three-dimensional object that draws attention and ideally accentuates the removable insert 3 placed in the display region 23. The ocular-stimulating accessory 8 can be mounted to the frame body 2 at any edge of the frame body 2 as desired. Provided the frame body 2 comprises an upper edge 81, a first lateral edge 82, and a second lateral edge 83, the ocular-stimulating accessory 8 can be positioned adjacent to the upper edge 81, the first lateral edge 82, or the second lateral edge 83. Potentially, multiple ocular-stimulating accessories 8 can be provided, with them being distributed between each edge of the frame body 2. FIG. 5 provides a visual example of both a printed graphic 7 on the edging frame 22 and one or more ocular-stimulating-accessories 8 mounted along the frame body 2.

As earlier referenced, multiple frame bodies can be coupled to a display. This allows for more than one advertisement to be provided for a display. Frame bodies can be attached to each side of a display, with a frame body 2 being provided for the top side, the left side, the right side, and even the bottom side of the display. Potentially, more than one frame body 2 could be attached to each side of the display, if desired. Multiple attached frame bodies 2 are shown in FIG. 6-FIG. 10.

As the present invention is applicable to a number of display types and sizes, the dimensions of each frame body 2 and removable insert 3 can be adapted in order to best suit a specific display. Similarly, a variety of materials and finished can be used for the construction of the present invention. Potentially, in order to better match a specific display, a frame body 2 can be made to have a similar color and material as a certain display. For example, black matte plastic can be used for the frame body 2 to better mesh with a television display that has a black matte plastic bezel. Ultimately, though, the color, material, number of frame panels, and further aspects can be altered as desired by a manufacturer, customer, or other entity.

Although the invention has been explained in relation to its preferred embodiment, it is to be understood that many other possible modifications and variations can be made without departing from the spirit and scope of the invention as hereinafter claimed.

What is claimed is:

1. A system of peripheral advertisements about a display panel comprising:

at least one advertising unit;

the at least one advertising unit comprising a frame body and a removable insert;

the frame body comprising a backing, an edging frame, a display region and an item-receiving slot;

the edging frame comprising a front surface, a rear surface opposite to the front surface, an interior surface and an exterior surface opposite to the interior surface, the front surface and the rear surface each being located in between and perimetrically surrounded by the interior surface and the exterior surface;

one of the rear surface and the exterior surface of the edging frame being perimetrically and adjacently connected to the backing, the backing corresponding to the rear surface;

the display region being delineated by the backing and the interior surface of the edging frame, the display region corresponding to the front surface;

the item-receiving slot traversing into the display region through the exterior surface and the interior surface of the edging frame;

the removable insert being positioned within the display region via the item-receiving slot;

an adhesive strip;

the adhesive strip being attached to the exterior surface for being selectively attached to the display panel, the adhesive strip being accessible upon attachment to the display panel by not being sandwiched in between the display panel and the rear surface;

the adhesive strip being further attached to a portion of the rear surface.

2. The system of peripheral advertisements about a display as claimed in claim 1 further comprising:

the frame body further comprising a bracing member;

the bracing member being adjacently and perpendicularly connected to the exterior surface of the edging frame; and the bracing member being positioned opposite the item-receiving slot along the edging frame.

3. The system of peripheral advertisements about a display as claimed in claim 1 further comprising:

a transparent cover; and the transparent cover being adjacently connected to the edging frame opposite the backing.

4. The system of peripheral advertisements about a display as claimed in claim 1 further comprising:

a plurality of illumination sources;

the plurality of illumination sources being adjacently connected to the edging frame; and the plurality of illumination sources being distributed around the display region.

5. The system of peripheral advertisements about a display as claimed in claim 1 further comprising:

a printed graphic; and the printed graphic being positioned onto the removable insert opposite the backing.

6. The system of peripheral advertisements about a display as claimed in claim 1 further comprising:

a printed graphic; and the printed graphic being positioned onto the edging frame opposite the backing.

7. The system of peripheral advertisements about a display as claimed in claim 1 further comprising:

an ocular-stimulating accessory;

the frame body comprising an upper edge, a first lateral edge and a second lateral edge; and the ocular-stimulating accessory being mounted to the frame body.

8. The system of peripheral advertisements about a display as claimed in claim 7 further comprising:

the ocular-stimulating accessory being positioned adjacent to the upper edge.

9. The system of peripheral advertisements about a display as claimed in claim 7 further comprising:

the ocular-stimulating accessory being positioned adjacent to the first lateral edge.

10. The system of peripheral advertisements about a display as claimed in claim 7 further comprising:

the ocular-stimulating accessory being positioned adjacent to the second lateral edge.

* * * * *